US008720001B2

(12) United States Patent
Courtney et al.

(10) Patent No.: US 8,720,001 B2
(45) Date of Patent: May 13, 2014

(54) TOOL FOR A SURFACE TREATING APPLIANCE

(75) Inventors: Stephen Benjamin Courtney, Bath (GB); Nicholas George Byatt, Bath (GB); James Elliot Cameron, Fort William (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 488 days.

(21) Appl. No.: 11/596,174

(22) PCT Filed: Apr. 25, 2005

(86) PCT No.: PCT/GB2005/001564

§ 371 (c)(1), (2), (4) Date: Nov. 21, 2007

(87) PCT Pub. No.: WO2005/111084

PCT Pub. Date: Nov. 24, 2005

(65) Prior Publication Data

US 2008/0178419 A1 Jul. 31, 2008

(30) Foreign Application Priority Data

May 13, 2004 (GB) ..... 0410699.3

(51) Int. Cl.
*A47L 9/04* (2006.01)

(52) U.S. Cl.
USPC ..... 15/389

(58) Field of Classification Search
USPC ..... 15/389, 363, 387, 388, 324, 337, 339, 15/392, 383, 391
See application file for complete search history.

(56) References Cited

U.S. PATENT DOCUMENTS

| | | | | | |
|---|---|---|---|---|---|
| 1,629,801 | A * | 5/1927 | Lindgren | ..... | 15/368 |
| 2,707,792 | A * | 5/1955 | Waller | ..... | 15/182 |
| 3,892,003 | A | 7/1975 | Peabody | | |
| 4,624,025 | A * | 11/1986 | Kaulig et al. | ..... | 15/41.1 |
| 5,373,598 | A * | 12/1994 | Weber et al. | ..... | 15/339 |
| 6,256,832 | B1 * | 7/2001 | Dyson | ..... | 15/324 |
| 6,324,714 | B1 * | 12/2001 | Walz et al. | ..... | 15/52.1 |
| 2004/0103496 | A1 | 6/2004 | Worwag | | |
| 2004/0148731 | A1 * | 8/2004 | Damman et al. | ..... | 15/388 |

FOREIGN PATENT DOCUMENTS

| | | |
|---|---|---|
| GB | 2346076 | 8/2000 |
| JP | 5-317214 | 12/1993 |
| JP | 6-86742 | 3/1994 |
| JP | 7-8422 | 1/1995 |
| JP | 7-39489 | 2/1995 |
| JP | 10-127542 | 5/1998 |
| JP | 2000-93365 | 4/2000 |
| JP | 2001-161610 | 6/2001 |
| JP | 2001-190463 | 7/2001 |
| JP | 2002-272653 | 9/2002 |
| JP | 2003-144358 | 5/2003 |

* cited by examiner

*Primary Examiner* — Robert Scruggs
(74) *Attorney, Agent, or Firm* — Morrison & Foerster LLP

(57) ABSTRACT

A tool for a surface treating appliance, such as a vacuum cleaner, includes a housing having a suction opening. An agitator, such as a brush bar, is rotatably located in the suction opening of the housing. The interior of such a tool can get blocked due to large objects being drawn in through the suction opening, or else by threads and fibers becoming tangled in the brush bar. The brush bar may be removed through the suction opening for replacement or repair. A portion of the housing may also be removable to clear the way for the user to access a narrow opening in the neck of the tool which may be prone to blockage.

12 Claims, 5 Drawing Sheets

TOOL FOR A SURFACE TREATING APPLIANCE

REFERENCE TO RELATED APPLICATIONS

This application is a national stage application under 35 USC 371 of International Application No. PCT/GB2005/001564, filed Apr. 25, 2005, which claims the priority of United Kingdom Application No. 0410699.3, filed May 13, 2004, the contents of both of which prior applications are incorporated herein by reference.

FIELD OF THE INVENTION

The invention relates to a tool for a surface treating appliance, such as a vacuum cleaner.

BACKGROUND OF THE INVENTION

Vacuum cleaners are typically of the upright or cylinder type. Cylinder cleaners consist of a main body containing a motor and fan unit for drawing an airflow into the main body and separating apparatus for extracting dirt and dust from the airflow and retaining it for disposal. The separating apparatus can be a cyclonic arrangement, bags, filters or a combination of these. A hose and wand assembly is connected to the inlet of the main body. A floor tool having a suction opening is attached to the end of the wand remote from the main body so that the suction opening can be manoeuvred across the surface to be cleaned by the user. Upright cleaners commonly have a cleaner head permanently attached to the main body of the vacuum cleaner which is manoeuvred, together with the main body, across the surface to be cleaned. However, many upright cleaners can also be operated in the manner of a cylinder machine by having a removable or releasable hose and wand assembly provided to which an accessory such as a floor tool can be attached.

Conventional floor tools typically comprise a housing which defines a downward-facing suction opening and in which is arranged a driven agitator in the form of a brush bar or beater, for example. Dirt and dust is dislodged from the carpet or other floor covering by the rotating brush bar or beater and the dirt and dust is drawn into the cleaner head by virtue of the suction produced by the downstream fan. Dirt laden air is then passed to the separation apparatus before clean air is expelled to the atmosphere.

A problem which may be encountered with such floor tools is that they may become blocked by small objects drawn by suction from the floor surface. Threads, fibres and hairs can also become entangled around the agitator, thereby jamming it. A user of the appliance needs to be able to access the interior of the tool to remove the blockage.

SUMMARY OF THE INVENTION

The invention provides a tool for a surface treating appliance comprising a housing, an agitator in the housing and a suction opening, in which the agitator is removable through the suction opening.

The provision of an agitator that is releasable through the suction opening greatly simplifies removal of the agitator for the purposes of clearing the floor tool of blockages or for replacement of the agitator.

Preferably, a catch is provided for releasing the agitator from its usual position in the housing. The catch may be activated by means of a lever, which also assists the user by producing a pivoting movement to remove the agitator from its position in the housing.

Advantageously, a flange is provided, in which the agitator is movably located. The lever may be arranged to act on the flange for removing the agitator. The flange may be an end cap in which the agitator is movably arranged. Part of the flange may form a pivot point with a region of the housing, such as a sole plate, for easy pivoting release of the agitator.

In accordance with another embodiment of the invention, a portion of the housing is removable so that a user can access the interior of the tool to remove blockages, especially those occurring in the neck of the tool. Preferably, this portion is releasable from the remainder of the housing against the force of resilient means.

At least a portion of the housing is transparent so that the user can see any blockages within the tool.

The agitator may comprise a brush bar or beater, which may be rotatably driven by means of a turbine.

BRIEF DESCRIPTION OF THE DRAWINGS

The invention will now be described, by way of example, with reference to the accompanying drawings, in which:—

Like reference numerals refer to like parts throughout the specification.

DETAILED DESCRIPTION OF THE INVENTION

Figure 1:
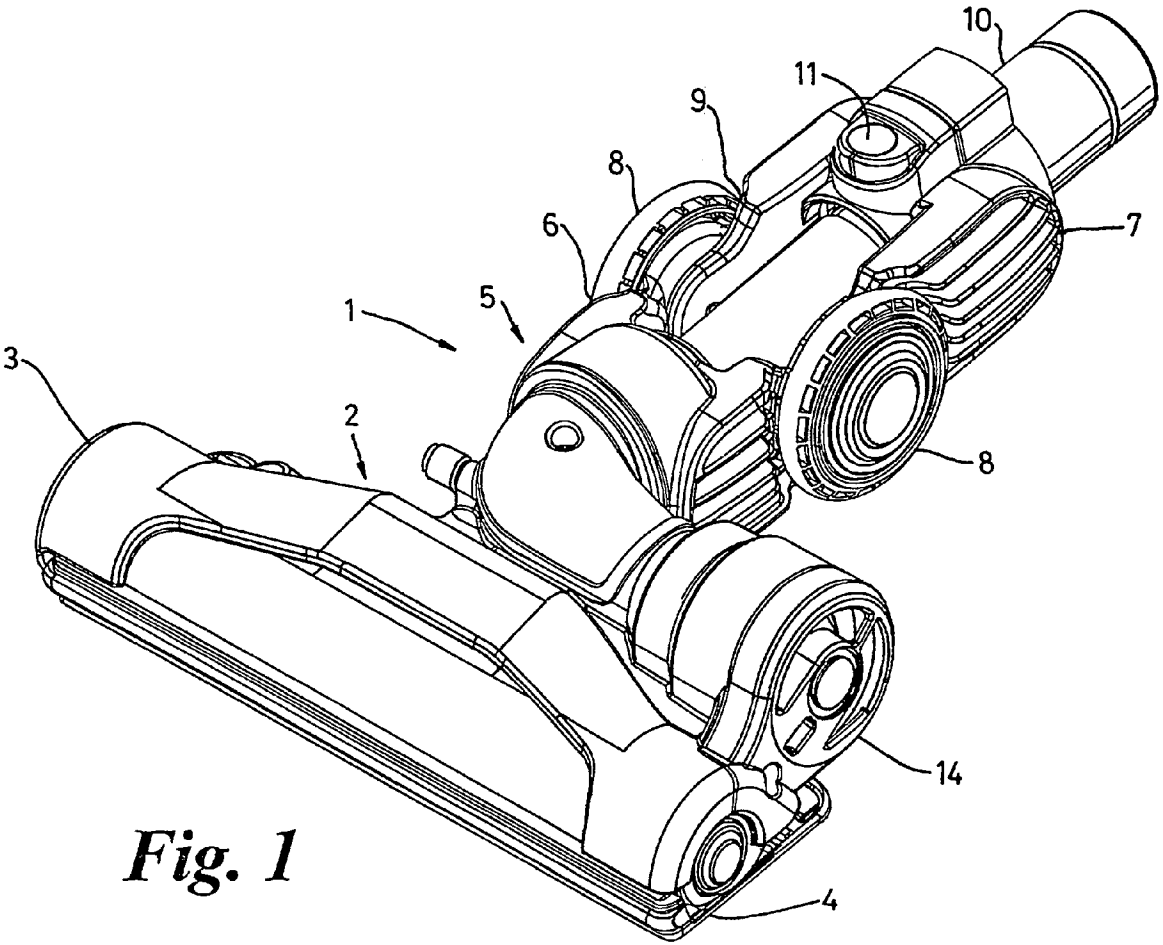
FIG. 1 is a perspective view of a tool constructed according to the invention.

The drawings show a floor tool for a vacuum cleaner, indicated generally by the reference numeral 1. The floor tool 1 has a head 2 formed by a housing 3 which has a suction opening 4 formed in the lower surface thereof. Part of the housing is transparent so that the user can view blockages in the tool 1. The floor tool 1 also includes a neck 5, which has a forward portion 6 and a rearward portion 7. The forward portion 6 carries two wheels 8 and is connected to the head 2 via a rotatable coupling 9. The rearward portion 7 has a collar 10 for receiving a wand or hose attached to the main body of the vacuum cleaner with which the floor tool 1 is to be used. A catch 11 may be provided on the rearward portion 7 for the purpose of retaining the hose or wand on the collar 10.

Figure 2A:
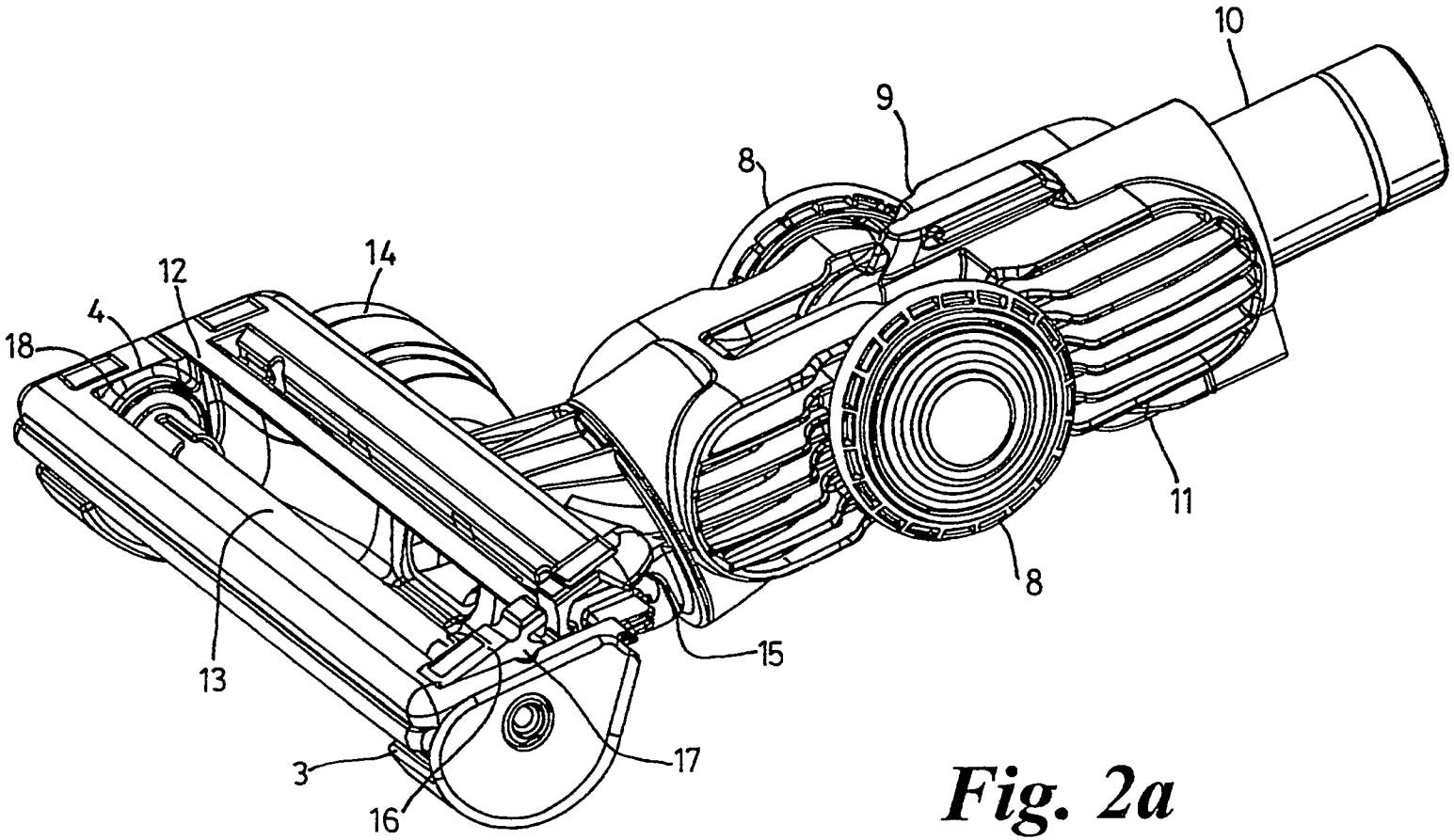
FIGS. 2*a* and 2*b* are perspective views from underneath of the tool of FIG. 1, showing removal of the agitator.
Figure 2B:
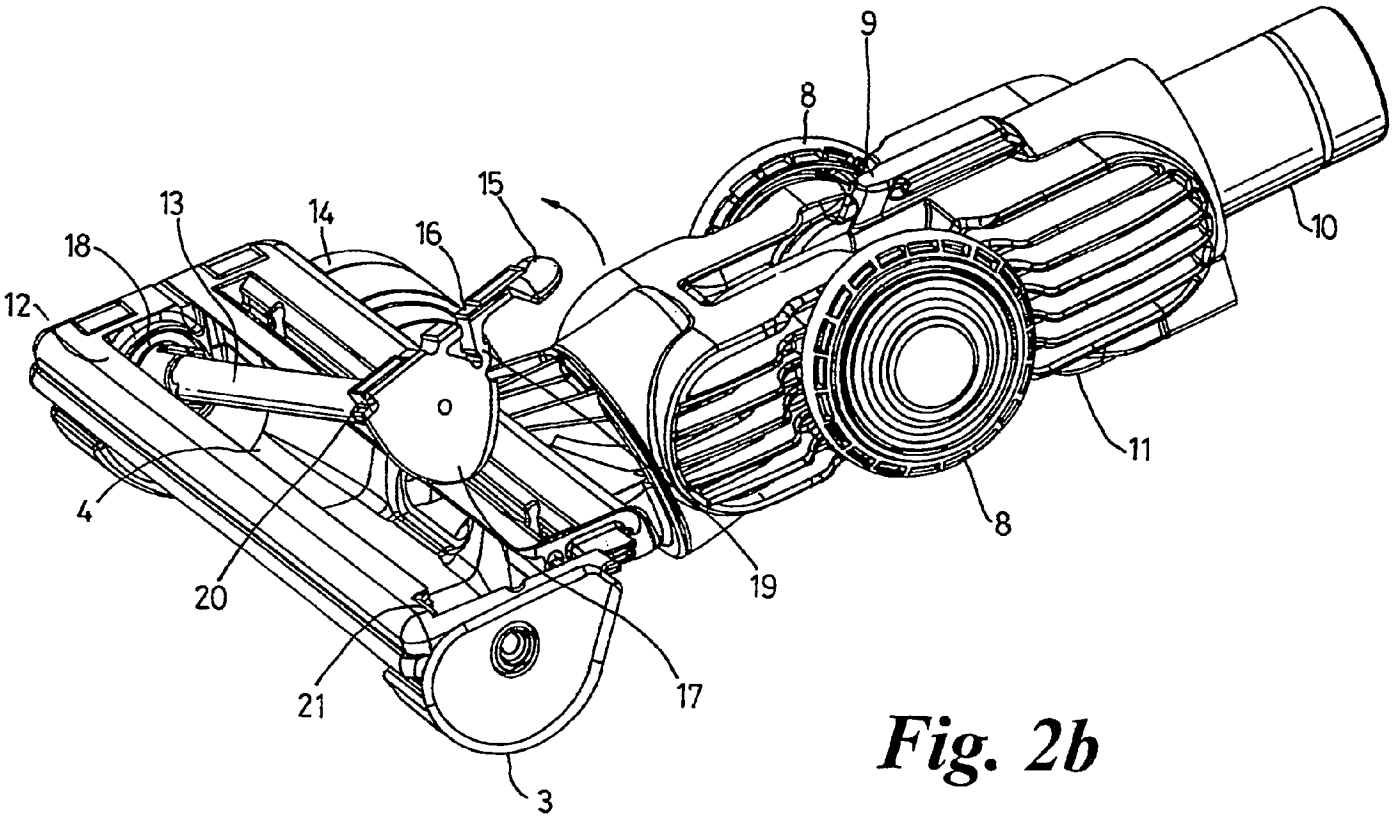

Referring to FIGS. 2*a* and 2*b*, a sole plate 12 is provided for engaging with the floor surface. The sole plate 12 may be fixed with respect to the housing 3 or may be pivotable to ensure that the sole plate keeps in intimate contact with irregular floor surfaces.

An agitator in the form of a brush bar 13 is rotatably supported in the housing 3 immediately above the suction opening 4. The brush bar 13 is located such that bristles or beaters carried by the brush bar project through the suction opening 4 as the brush bar rotates and agitate the surface to be cleaned. The brush bar 13 is shown in these drawings without bristles for the purposes of clarity. Ordinarily, a plurality of clusters of bristles are mounted onto a cylindrical core. The clusters of bristles are typically mounted in a helical formation at regular intervals around the entire circumference of the core and along its entire length or the majority thereof. The brush bar 13 is rotatably driven by means of a turbine 14, through which air is drawn by the motor of the vacuum cleaner, and a drive belt (not shown).

In accordance with the invention, the brush bar 13 is removable through the suction opening 4. Thus, a user can readily clear blockages in the floor tool 1, remove material that is tangled up in the bristles or else easily replace a worn brush bar.

A lever arm 15 is provided in order to facilitate removal of the brush bar 13. In this embodiment, the lever arm 15 forms part of one of the sides 16 of the sole plate and is integral with an end cap 17. The end cap 17 comprises one of a pair of end caps 17, 18 in which the end portions of the brush bar 13 are located in the housing 3. The other end cap 18 locating an end portion of the brush bar 13 is fixed to, or an integral part of, the housing 3 of the tool.

In use, the user applies a turning moment to the free end of the lever arm 15. The arm 15 is made from a resilient material, such as plastic. Thus, the force applied to the lever arm 15 causes it to flex slightly, thereby releasing a catch (part 19 of which is visible in these drawings) holding the end cap 17 in place in the housing 3. The end cap 17 is freed from its location in the housing 3. The user can continue to apply a turning moment to the lever arm 15 in the direction of the arrow. A notch 20 is provided in the end cap 17, which notch co-operates with a region 21 of the front of the sole plate to provide a suitable point about which to pivot the end cap. Thus, the end cap 17 is released from the housing 3 through the suction opening 4. The user then simply slides the other end portion of the brush bar 13 out of its respective end cap 18 in the housing 3 through the suction opening 4. Thus, the brush bar arrangement comprising the brush bar 13 itself, the end cap 17 and the lever arm 15 is released from the tool 1 entirely through the suction opening 4. The brush bar 13 is easily removed from the end cap 17, if required.

In order to replace the brush bar arrangement, the user simply reverses this operation. One end portion of the brush bar 13 is placed in the end cap 18 that forms part of the housing 3. The other end portion of the brush bar 13 slots into the removed end cap 17, which is introduced to the housing 3 by engaging the notch 20 in the region 21 of the sole plate 12 and pivotably moving the end cap towards the housing accordingly. The member comprising the end cap 17 and lever arm 15 is arranged to fit into the housing 3 in a snap fit manner, so that the user can simply push the brush bar arrangement back into position. Alternatively, the arm 15 or the end cap 17 may have a spring clip or other fastener for holding the brush bar 13 in the housing 3 in normal use.

Figure 3:
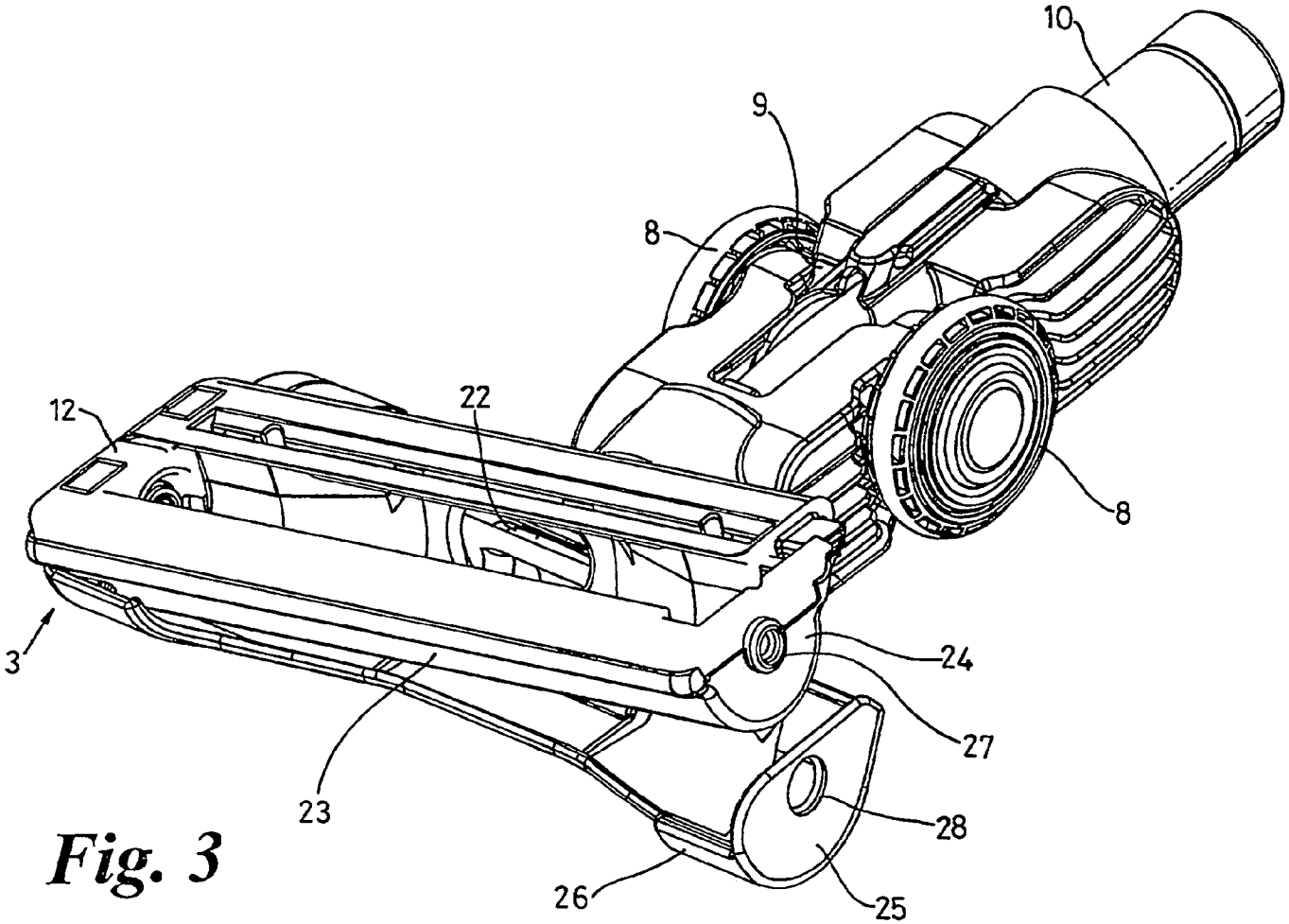
FIG. 3 is a perspective view from underneath of the tool of FIGS. 1, 2*a* and 2*b*, showing removal of a portion of the housing.

Additionally, the user may need to gain access to a narrow opening 22 in the neck 5 of the floor tool. The cross-sectional area of the opening 22 in the neck 5 is less than that of the suction opening 4. Therefore, large particles of debris and other objects can become blocked in this opening 22. In accordance with an alternative embodiment of the invention, a portion 23 of the housing is removable from the floor tool 1, as shown in FIG. 3.

In this embodiment, the removable portion 23 of the tool 1 comprises the front lower portion, which portion includes a transparent region and the sole plate 12 of the tool. The lower portion 23 of the tool includes an end face 24 which is normally behind one side wall 25 of the upper portion 26 of the tool. The end face 24 of the removable portion 23 has a collar 27 which is located in an aperture 28 on the side wall 25. The collar 27 may be arranged to hold the lower portion 23 in a fixed relationship with respect to the upper portion 26, or may provide a predetermined amount of relative pivoting movement to keep the sole plate 12 in intimate contact with irregular floor surfaces in use.

Both the upper 26 and lower 23 portions of the floor tool 1 are of plastics materials having a certain degree of flexibility. Thus, in order to release the lower portion 23, the user urges the portions of the tool 1 to flex apart with respect to each other. The most straightforward manner of achieving this with the illustrated embodiment is to depress the collar 27 located in the aperture 28 on the side wall 25 so that it pops out of the aperture. Thus, the lower portion 23 including the transparent region and the sole plate 12 can be pulled out of the housing 3. The removable portion 23 locates in the housing 3 by means of a simple snap fit for easy replacement.

Figure 4:
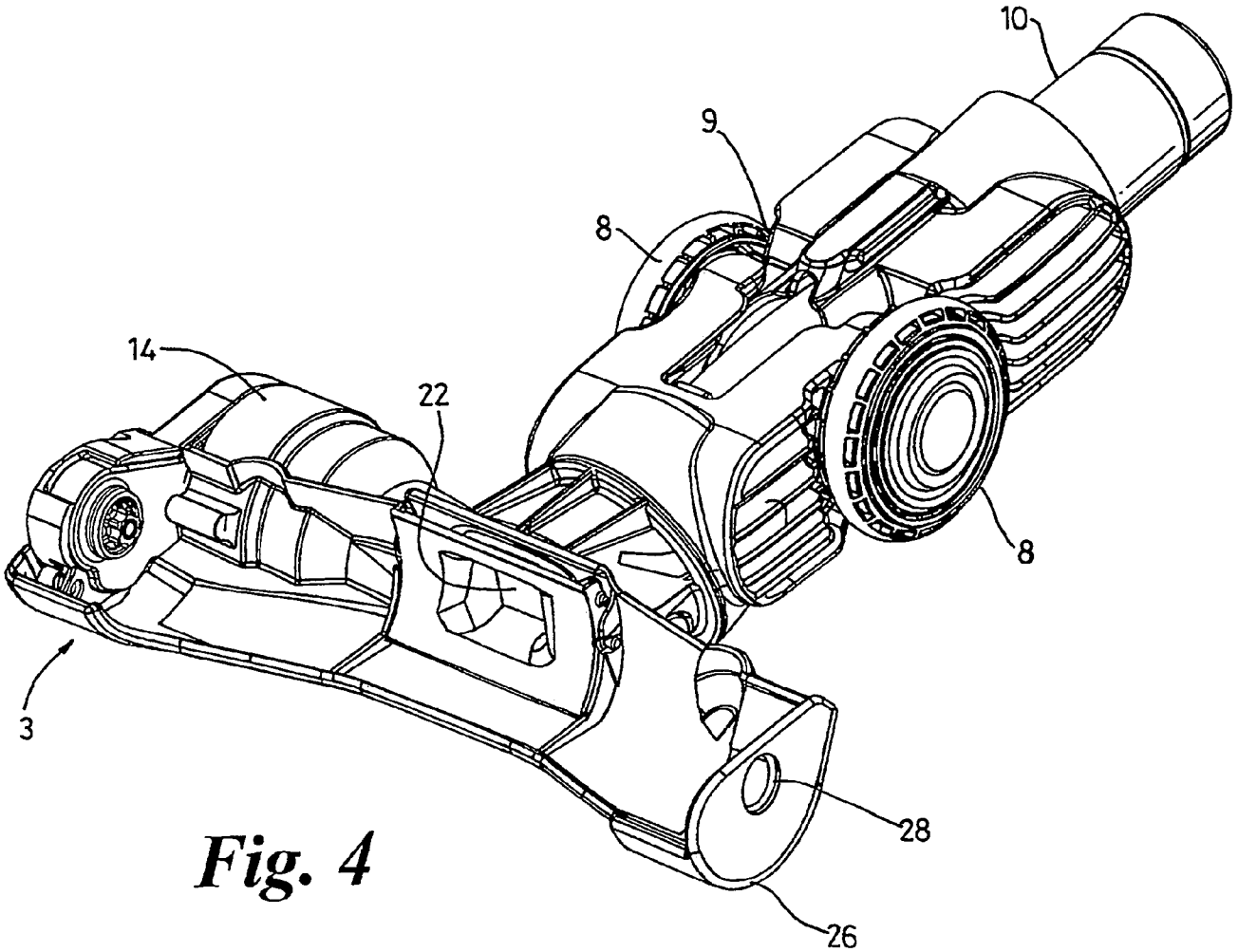
FIG. 4 is a perspective view from underneath of the tool of FIGS. 1, 2*a*, 2*b* and 3 with the agitator and a portion of the housing removed.

FIG. 4 shows the floor tool 1 without the removable portion. The opening 22 in the neck 5 of the tool is easily accessible by the user so that any blockages in the tool can be removed.

The invention permits the user easily to clean and maintain the floor tool himself, thereby saving the user the extra cost and the inconvenience of arranging for the tool to go into a repair shop. The removal of the brush bar arrangement through the suction opening greatly simplifies replacement of the brush bar.

Further variations will be apparent to the person skilled in the art. For example, other agitators in the form of brushes or beaters may be employed instead of the brush bar. The lever need not communicate with an end cap for locating the brush bar, as some other flange arrangement may be substituted. For example, the flange may locate a central region of the agitator in the housing. Furthermore, the lever may communicate directly with the agitator, so that a flange or end cap arrangement is not required. The agitator need not be rotatably mounted in the housing, but could instead be made, for example, to oscillate. The brush bar may be mounted in a cradle, which, in turn, is moveable with respect to the housing. The cradle permits the suction opening to float over the surface being treated. The removable portion of the housing may comprise this cradle. Furthermore, the tool need not include a turbine for driving the brush bar.

The invention claimed is:

1. A tool for a surface treating appliance comprising:

a housing having a sole plate for engaging a floor surface, an agitator arranged inside the housing, the agitator having a first end portion and a second end portion opposite the first end portion, a suction opening located on the housing, an end cap arranged to locate the agitator in a predetermined position in the housing, the first end portion of the agitator being rotatably arranged in the end cap, the end cap having a notch arranged to cooperate with a region of the sole plate to provide a pivot point proximate to the first end portion, and a lever arm located proximate to the first end portion of the agitator, and configured to lever the end cap and the first end portion of the agitator together about the pivot point and out through the suction opening.

2. A tool as claimed in claim 1, in which the lever arm is associated with a catch for releasing the agitator from a predetermined position in the housing.

3. A tool as claimed in claim 1 or 2, in which the lever arm forms part of a sole plate associated with the suction opening.

4. A tool as claimed in claim 1 or 2, in which a portion of the housing is removable.

5. A tool as claimed in claim 4, in which the removable portion is releasable from the housing against the force of a resilient member.

6. A tool as claimed in claim 1 or 2, in which at least a portion of the housing is transparent.

7. A tool as claimed in claim 1 or 2, in which the agitator comprises a brush bar or beater.

8. A tool as claimed in claim 1 or 2, further comprising a turbine for driving the agitator.

9. A surface treating appliance incorporating a tool as claimed in claim 1 or 2.

10. A surface treating appliance as claimed in claim 9, in the form of a vacuum cleaner.

11. A method of releasing an agitator, having a first end portion and a second end portion opposite the first end portion, from a tool of a surface treating appliance comprising a housing having a sole plate for engaging a floor surface, the method comprising:

removing the agitator from the housing of the surface treating appliance through a suction opening of the housing a lever arm on the tool, the lever arm applying force to an end cap arranged to locate the agitator in a predetermined position in the housing and to lever the agitator and the end cap from the predetermined position so as to remove the agitator and the end cap through the suction opening, an end portion of the agitator being rotatably arranged in the end cap and the end cap having a notch arranged to cooperate with a region of the sole plate to provide a pivot point for levering the agitator and the end cap from the predetermined position, wherein the lever arm and the end cap are located proximate to the first end portion of the agitator such that the lever arm levers the first end portion of the agitator about a pivot point that is proximate to the first end portion of the agitator.

12. A tool for a surface treating appliance, the tool comprising:

a housing having a sole plate for engaging a floor surface, an agitator, having a first end portion and a second end portion opposite the first end portion, connected at the first end portion to an end cap, wherein the end cap has a notch arranged to cooperate with a region of the sole plate to provide a pivot point proximate to the first end portion, and wherein the agitator and the end cap are configured to be removable through a suction opening in the housing and to be secured in the housing via a catch located proximate to the first end portion of the agitator, and a lever, located proximate to the first end portion of the agitator, configured to release the catch and to pivot about the pivot point following the release of the catch in order to lever the end cap and the first end portion of the agitator from their position in the housing.

* * * * *